United States Patent [19]

Pasternicki

[11] Patent Number: 4,787,509

[45] Date of Patent: Nov. 29, 1988

[54] MULTI-ITEM PACKAGING FOR RETAINING A PLURALITY OF OBJECTS

[75] Inventor: Michel Pasternicki, Saint-Arnoult-En-Yvelines, France

[73] Assignee: Paker S.A., Luce, France

[21] Appl. No.: 113,624

[22] Filed: Oct. 26, 1987

[30] Foreign Application Priority Data

Oct. 27, 1986 [FR] France ..... 86 14904

[51] Int. Cl.[4] ..... B65D 67/00

[52] U.S. Cl. ..... 206/427; 206/460; 229/40

[58] Field of Search ..... 206/427, 429, 434, 460, 206/426, 192, 193, 197; 229/40

[56] References Cited

U.S. PATENT DOCUMENTS

| | | | |
|---|---|---|---|
| 1,865,742 | 7/1932 | Chapman | 229/2.5 |
| 2,015,294 | 9/1935 | Stein | 217/56 |
| 2,727,674 | 12/1955 | Rous | 206/429 |
| 2,913,105 | 11/1959 | Brunsing | 206/429 |
| 2,963,198 | 12/1960 | Foster et al. | 229/52 B |
| 3,037,682 | 6/1962 | Daulort . | |
| 3,123,214 | 3/1964 | McReynolds, Jr. | 206/434 |
| 3,300,041 | 1/1967 | Fuller | 206/192 |
| 3,409,124 | 11/1968 | Jorgensen | 206/434 |
| 3,411,697 | 11/1968 | Hightower et al. . | |
| 3,463,306 | 8/1969 | Taylor | 206/434 |
| 3,688,969 | 9/1972 | Gabaraz | 206/427 |
| 3,902,992 | 9/1975 | Schuster | 206/427 |
| 3,948,388 | 4/1976 | Mueller | 206/192 |
| 4,262,814 | 4/1981 | Roccaforte | 215/232 |
| 4,441,611 | 4/1984 | Sommariua | 206/460 |
| 4,703,847 | 11/1987 | Oliff | 206/434 |

FOREIGN PATENT DOCUMENTS

| | | | |
|---|---|---|---|
| 2331193 | 1/1975 | Fed. Rep. of Germany | 206/460 |
| 1380240 | 1/1975 | United Kingdom | 206/434 |

*Primary Examiner*—David T. Fidei

*Attorney, Agent, or Firm*—Blakely, Sokoloff, Taylor & Zafman

[57] ABSTRACT

The invention relates to multi-item packaging for retaining a plurality of objects, the packaging comprising a card panel for wrapping around said objects and for retaining them after two flaps of said panel have been connected together. According to the invention the packaging includes at least one pre-cut (7) defining a detachable portion (8) capable of being fixed to each object (9), said detachable portion thus serving to hold its packaged object and being automatically removed from the panel (1) when the packaging is opened and remaining fixed to the associated object. The invention is applicable to packaging jars, tins, bottles, and other objects, and more particularly to packaging yogurt pots either individually or in groups, with the pots being disposed in one or two rows.

13 Claims, 2 Drawing Sheets

MULTI-ITEM PACKAGING FOR RETAINING A PLURALITY OF OBJECTS

FIELD OF THE INVENTION

The present invention relates to multi-item packaging intended for retaining a plurality of objects, in particular it relates to packaging of the type constituted by a panel of card suitable for wrapping round said objects and for retaining them once two flaps of said panel have been fixed together.

The objects in question may be bottles, jars, tins or cans of food, etc.; however the types of object most particularly concerned are small plastic pots or glass jars as used for yogurt, for example, which come in many shapes (cylindrical, frusto-conical, and pyramid-shaped, in particular).

BACKGROUND OF THE INVENTION

Numerous types of multi-item packaging of this nature already exist in which the flaps are fixed together by gluing or by inter-fitting tongues to enable the panel of card to surround the objects or groups of objects concerned as well as possible.

The very wide variety of shapes of packaged objects often gives rise to object-holding problems that are solved in various different ways.

In addition to slots cut through the panel of card, e.g. for receiving the top rim of a plastic pot or a group of plastic pots, object-holding problems are conventionally solved by providing separator elements which generally project inwardly between the bases of the packaged objects or groups of objects or else which form an intermediate partition through which the objects extend.

FIGS. 3 and 4 of French Pat. No. 2 082 413 show a typical intermediate partition type of separator element. The objects are held very well, but this requires the panel of card to be provided with a large additional flap.

If such an intermediate partition is to be avoided, projecting elements for separating the objects must be provided, in particular for separating two rows of objects.

Proposals have thus been made to use one end of the card panel in order to constitute a separator element.

When the objects are substantially cylindrical, the problem is generally solved by a middle keel-forming flap as shown in French Pats. Nos. 1 348 109, 1 450 986, and 1 470 577. The quantity of card required to form such a middle flap is considerably less than the quantity required to constitute a genuine intermediate transverse partition, but its holding effect is negligible with the middle flap merely defining a separating strip between two rows of objects. Another possible solution that has been proposed makes it possible to avoid using an additional strip to constitute a middle flap, by cutting out tabs in the card panel in judicious locations for being folded inwardly between two rows of objects: such separator tabs are illustrated, for example, in French Pat. No. 1 264 708, however they do not hold the packaged objects in any way.

With the above-mentioned techniques using a keel or cut out separator tabs, objects are held solely by notches for receiving a portion of the object to be held.

When the objects are not cylindrical, for example when they are frusto-conical or pyramid-shaped, the problem of holding the objects is generally solved by using an additional strip which extends one of the ends of the card panel, with said strip being folded in the general folding direction of said panel in order to constitute a separator beam, which may itself optionally include notches for receiving the bottom portions of objects or groups of objects.

Triangular section beams have thus been developed which are defined by three parallel fold lines. In this case, the other flap of the panel is extended to pass beneath the beam and they are fixed together by two lines of glue on either side of said beam.

Square or rectangular section beams have also been developed, as shown in French patent application No. 2 521 100, for example, which are defined by four parallel fold lines. In this case, the end strip of the beam is either glued (in which case it may be narrow but glue is required) or else extended to pass beneath a row of objects, thus avoiding the need for gluing, but requiring additional card. The packaaging is then fixed simply by gluing the other flap beneath the beam of the first flap.

The major drawback common to these techniques using a holding beam lies is the additional card required to form the beam and this has a significant effect on the cost of making multi-item packaging. The extra portion of card corresponding to a conventional rectangular beam represents nearly 20% of the length of the panel for wrapping round the objects, and this is not negligible in packaging which is necessarily non-return packaging. This drawback is accompanied by the additional drawback of shaping the beam, with the shaping frequently being followed by gluing performed in the factory (unless the flap is enlarged in order to avoid the need for gluing), and the packaging is easily tampered with (it is often easy to remove a packaging object and then return it without leaving any visibile trace on the packaging).

Further, spot connections have also been made using glue between multi-item packaging and the packaged objects. In theory, this technique might appear to be satisfactory for holding the objects; however it suffers from a major drawback which doubtless explains why it is not successful with the public. When the packaging is torn open to gain access to the objects, the removed objects always come away with a certain quantity of delaminated card, thereby leaving fibers and/or traces of glue so that, once removed from its packaging, the object looks poorly finished and unattractive.

The state of the art is also shown by U.S. Pat. No. 4,262,814. This patent described multi-item packaging for capped receptacles, with the packaging being made from a card panel whose structure is such that any attempt at removing a cap causes the panel to be torn. A central aperture 25 (FIG. 1) is provided for labelling a cap. More particularly, FIGS. 18 to 21 show a variant in which a separable portion 152 is provided to close the above-mentioned apperture 25. A series of packages for receptacles of the same category can thus be coupled together by a common separate strip 157 which is glued to each of the separable portions 152 such that by pulling on the strip, an employee can remove all of the separable portions (FIG. 21) and can then proceed to label the central zone of each cap which has thus become accessible without any risk of mis-labelling.

The technical problem solved in this document is to facilitate rapid access to the caps for error-free labelling by virtue of simultaneous uncovering.

Finally, by way of technological background, mention may be made of U.S. Pat. No. 3,037,682 describing packaging constituted by a card panel having detachable side disks which, after they have been detached, constitute protective mats for protecting table tops when an object having a high degree of moisture on its outside surface is placed thereon. Mention is made, for the record, of one or two special applications for the tongues cut out in a card blank for packaging: these tongues may be for separation purposes (see French Pat. No. 2 547 796, for example), or they may facilitate aeration of the top portions of the packaged objects (see U.S. Pat. No. 3,411,697, for example).

A first aim of the invention is to provide multi-item packaging suitable for reliably holding packaged objects or groups of objects without requiring additional material.

Another aim of the invention is to provide multi-item packaging suitable for use with a very wide range of object shapes, and in particular for use with pots which are generally frusto-conical or pyramid-shaped.

Another aim of the invention is to use a technique including a glued connection between card packaging and the packaged objects or groups of objects, while avoiding any risk of the card delaminating and/or traces of glue showing on the objects after they have been separated from the packaging.

Another aim of the invention is to provide tamper-proof multi-item packaging, i.e. packaging which must be at least partially destroyed in order to disengage a packaging object.

SUMMARY OF THE INVENTION

The present invention provides multi-item packaging for retaining a plurality of objects, the packaging comprising a card panel for wrapping around said objects and for retaining them after two flaps of said panel have been connected together, the packaging being characterized by the fact that it includes at least one pre-cut defining a detachable portion capable of being fixed to each object or interconnected group of objects by gluing, said detachable portion thus serving to hold each packaged object or group of objects and being automatically removed from the panel when the packaging is opened and remaining fixed to the associated object or group of objects.

In particular, when the packaging is of the type in which a central portion of the panel directly overlies the top face of a plurality of packaged objects, the pre-cut associated with each object runs around a closed contour defining a separable patch. In this case, it may be advantageous for the contour to be similar in shape to the top face of the object, whereby the detached patch covers a substantial portion of said face.

In a variant of the invention, when the packaging is of the type in which a side portion of the folded panel is spaced apart from the adjacent face of a plurality of objects wrapped in the panel, the pre-cut associated with each object runs along a line which transversely interconnects two points of a continuous cutout defining a tongue, the pre-cut running along a direction which is substantially parallel to the connecting hinge of said tongue.

In particular the hinge of the tongue is essentially parallel to the general fold direction of the card panel, or even essentially coincident with one of the fold lines.

In accordance with another particularly advantageous feature of the invention, each tongue includes a narrow neck which is extended by a broader head beyond the pre-cut, with said head defining a separable patch. In some cases, the neck of each tongue has an intermediate fold line disposed between the hinge and the pre-cut of said tongue. Naturally the head of the tongue may have a wide variety of shapes. In a first example, the head of each tongue is generally square or rectangular with the associated pre-cut being rectilinear and running along one of its sides, and extending the portion of the continuous cutout relating to said side. In another example, the head of each tongue is generally circular or oval in shape with the associated pre-cut being correspondingly curved in order to run into the associated continuous cutout.

Several dispositions may be envisaged for the tongues, as a function of the particular shape of the packaged objects. Three typical cases serve to illustrate the variety of dispositions that may be adopted:

with packaging in which the objects wrapped in the card are organized in one or two rows and are generally frusto-conical or pyramid-shaped with an upward flare, the tongue associated with each object is adjacent to a side wall of the object and extends downwardly when the card panel is folded, the tongue having a hinge which is essentially parallel to the fold direction of said panel;

with packaging in which the objects wrapped in the card are organized in one or two rows and are generally frusto-conical or pyramid-shaped with a downward flare, and have tops which are recessed in the middle, the tongue associated with each object is adjacent to the top of the object and extends inwardly when the card panel is folded, the tongue having a hinge which is essentially parallel to the fold direction of said panel; or with packaging in which the objects wrapped in the card are organized in one or two rows and have bottoms which are recessed in the middle, the tongue associated with each object is adjacent to the bottom of the object and extends inwardly when the card panel is folded, the tongue having a hinge which is essentially parallel to the fold direction of said panel.

BRIEF DESCRIPTION OF THE DRAWINGS

Embodiments of the invention are described by way of example with refence to the accompanying drawings, in which.

MORE DETAILED DESCRIPTION

In the following description, the term "pre-cut" is used frequently. It should be understood that this term is used to mean a succession of perforated points or segments disposed around a contour to define a line of weakness so that separation can take place therealong by application of a relatively small tearing force.

Figure 1:
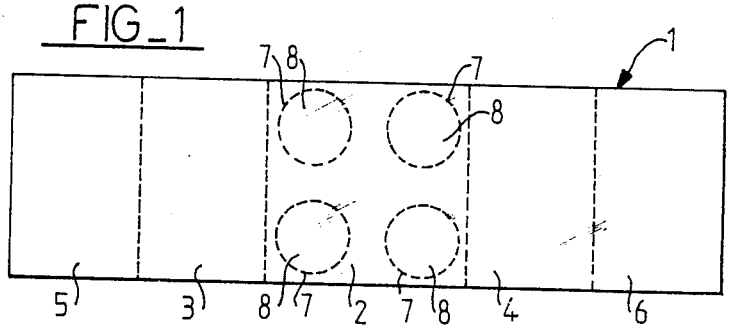
FIG. 1 is an elevation view of multi-item packaging in accordance with the invention while in the form of a flat blank, and it illustrates the case where a central portion of the panel is intended to directly overlie the top face of a plurality of packaged objects, and has separable patches which are round in this case.

In FIG. 1, the multi-item packaging 1 is made of card and is generally rectangular in shape, with a central portion 2, side flaps 3 and 4, and end flaps 5 and 6.

In accordance with the invention, the packaging 1 includes at least one pre-cut contour 7 (there are four in this case) defining a detachable portion 8 which in this case is in the form of a round patch which may be glued to a corresponding object. These detachable patches, as provided in this case in the central portion 2, serve to hold the associated objects, and when the packaging is opened, they are automatically disconnected from the panel 1 and remain fixed to said objects.

Figure 2A:
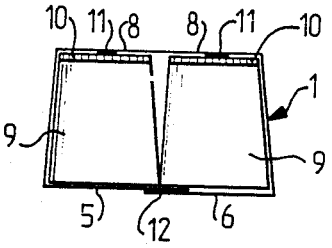
FIGS. 2*a* and 2*b* are an end view and a perspective view of a set of four pots having crimped-on tops and packaged in the FIG. 1 multi-item packaging.
Figure 2B:
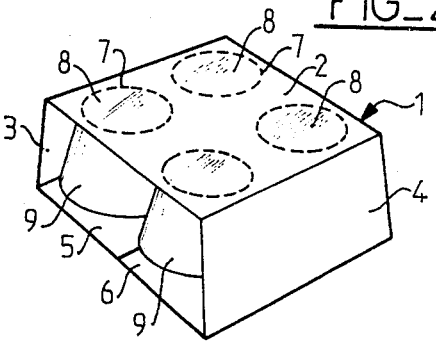

FIGS. 2*a* and 2*b* show objects having crimped-on tops 10, e.g. pots of yogurt, which are packaged using the multi-item packaging 1. A small quantity of glue 11, which is preferably deposited on the tops rather than on the panel in order to simplify packaging operations, serves to fix each pot 9 to the packaging 1, and the end flaps 5 and 6 are then folded and finally fixed together along their edges by spots of glue 12 (or by a continuous strip of glue). These operations are performed continuously using a conventionally designed machine that need not be described here. The central portion of the panel is glued using hot melt glue or, if it is desired to consolidate the set of pots initially, a cold glue is used whose drying time is longer.

The packaged assembly holds together well and each pot is individually bonded to the panel. It may be observed that when using frusto-conical pots that flare downwardly, the bases of the pots are preferably joined to one another so that the assembly has excellent cohesion making it possible to perform any of the handling operations required in storage, etc.

It will readily be understood that any destruction, even if only partial, of the packaging in order to gain access to a packaged object will cause the corresponding patch 8 to become separated along its pre-cut line 7. The patch thus remains fixed to the object removed and can then be used for labelling purposes (with the label being decorative and/or explanatory). The patch 8 completely hides the glue and its outline is clean in appearance because of the pre-cut 7. There is thus no danger of card fibers being visible dueto the panel delaminating.

It should be observed that if the objects have crimped-on tops, as shown in FIGS. 2*a* and 2*b*, the pre-cut 7 should be sufficiently fragile for the patch to become detached easily without opening the top of the object.

In this case, the pre-cut outline is round like the top face of the pot; however it is naturally be possible to use a different shape and/or size of outline.

Figure 3:
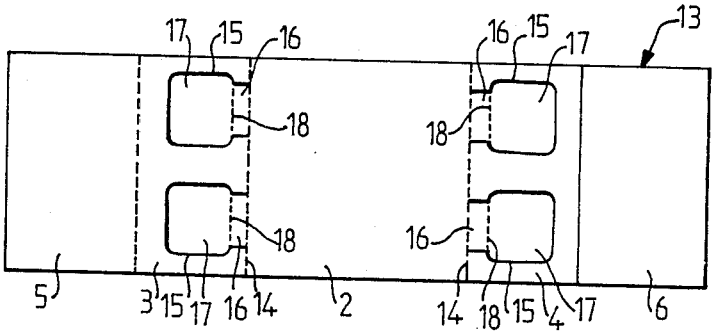
FIG. 3 is an elevation view similar to FIG. 1 showing a variant in which tongues having detachable heads are provided, with a pre-cut portion defining a separable patch which is rectangular in shape.

The panel 13 shown in FIG. 3 shows a variant of multi-item packaging in accordance with the invention. In this variant, the side flaps 3 and 4 include a plurality of continuous cutouts 15 (i.e. one cutout per packaged object) running from the flap fold line 14. In practice, each continuous cutout advantageously leaves very weak isolated bridges in the corners so as to avoid any danger of the blanks becoming tangled with one another while they are being unfolded for packaging purposes.

Each continuous cutout 15 defines a tongue which in this case is constituted by a neck 16 and a head 17 of larger size and a which is rectangular in shape. Each tongue is thus free to pivot about its connecting hinge which in this case coincides with the fold line 14, although that is not essential. Each tongue additionally includes a pre-cut 18 running transversely between two points of the continuous cutout 15 in a direction substantially parallel to the connecting hinge. The pre-cut 18 is preferably rectilinear in this case in order to finish off the remaining side of the rectangle which is already partially cut out. The separable patch is thus the head 17 of the tongue. Naturally, the neck could be as wide as the head, but in this case tearing would begin in the vicinity of the corners and that gives less satisfactory final appearance.

Figure 4A:
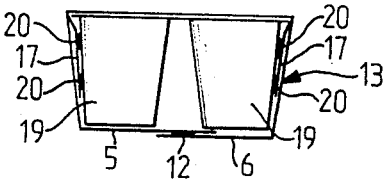
FIGS. 4*a* and 4*b* are an end view and a perspective view of a set of four pyramid-shaped pots packaged using the multi-item packaging of FIG. 3.
Figure 4B:
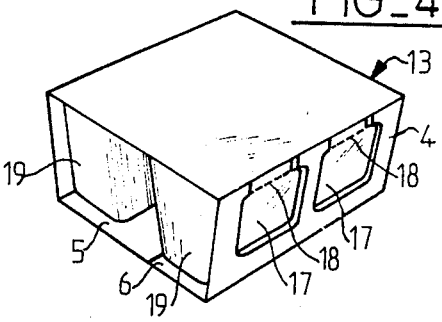

Multi-item packaging of the type including a panel 13 thus serves to hold the packaged objects by gluing the detachable portions (patches 17) of the panel to the adjacent side faces of the objects. This is shown in FIGS. 4*a* and 4*b* which depict objects 19, e.g four yogurt pots, which pots are generally pyramid-shaped being upwardly flared, and are optionally interconnected.

The neck 16 of each tongue enables the separable patch 17 associated therewith to be displaced from the plane of the flap so that each patch can easily be pressed against the adjacent sloping side face and fixed thereto by one or more spots of glue 20. The end flaps are also interconnected by glue at 12, as for the preceding packaging.

It will readily be understood that removal of an object 19 automatically causes the patch 17 fixed thereto to be separated from the packaging, thus providing the same advantages as mentioned above.

Figure 5:
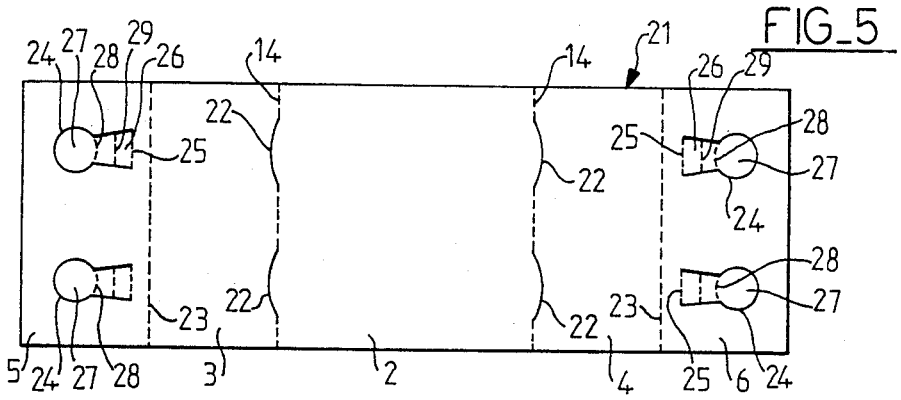
FIG. 5 is an elevation view of packaging in the form of a flat blank, showing another variant in which the tongues are disposed on the end flaps of the panel, with said tongues including pre-cut portions defining separable patches which are round in shape.

The panel 21 shown in FIG. 5 shows another variant of multi-item packaging in accordance with the invention. In this variant, the flaps which include the pre-cut tongues are the end flaps 5 and 6.

Slots 22 are provided at the fold lines 14 in order to allow the top rims of the packaged pots to project out from the packaging in conventional manner. Beyondthe fold 23 there are continuous cuts 24 running from lines 25 which constitute connecting hinges for the tongues defined by the cuts 24, with each hinge extending substantially parallel to the fold lines 23. As before, each tongue includes a neck 26 and a head 27, with a pre-cut 28 in the form of a circular arc in order to complete the circumference of the circle which has already been cut out around the head of the tongue (an isolated bridge point may be left around the cut out portion of the circumference to prevent any risk of the card blanks from becoming tangled). In this case, the head of each tongue is generally circular in shape so that the resulting detachable patch is round.

Figure 6A:
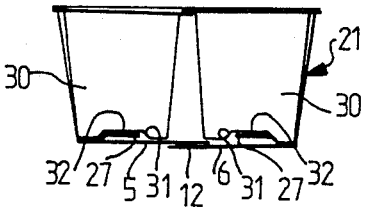
FIGS. 6*a* and 6*b* are an end view and a perspective view of a set of four frusto-conical pots having recessed bases and packaged using the multi-item packaging of FIG. 5.
Figure 6B:
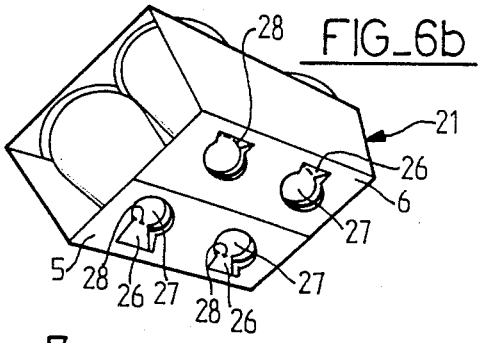

Unlike the tongues in the preceding variant, in this case, the neck 26 of each tongue includes an intermediate fold line 29 disposed between the hinge 25 and the pre-cut 28 of the tongue. This provides additional flexibility in order to displace the heads of the tongues a considerable distance when they are glued to the objects to be held, in particular when the objects have bottoms including central recesses. This is shown in FIGS. 6*a* and 6*b* which depict such objects 13 having recessed bottoms 31. Each patch 27 is thus easily applied against the adjacent bottom 31 and fixed thereto by a spot of glue 32. The end flaps are also interconnected by glue at 12, as for the precediing packaging.

It should be observed that the tongues are preferably disposed so as to extend inwardly when the card panel has been folded, as shown, in order to oppose any tendency that the bases of the two rows of objects may have to move towards each other, thereby holding the packaged objects better.

It will readily be understood that when an object 30 is removed, the patch 27 fixed thereto is automatically separated from the packaging, giving rise to the same advantages as mentioned above.

Figure 7:
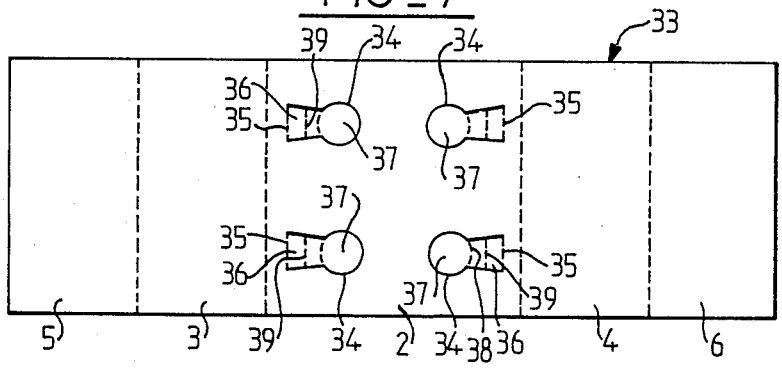
FIG. 7 is an elevation view of packaging in the form of a flat blank, showing another variant in which the tongues are disposed in the central portions of the panel with each tongue including a pre-cut portion defining a separable patch which is round in shape.

The panel 33 shown in FIG. 7 shows yet another variant of multi-item packaging in accordance with the invention. This variant is based on the same principles as the preceding variant, however the pre-cut tongues are provided on the central portion 2 of the panel. Here again, each tongue includes a continuous cutout 34 running from its connecting hinge 35, thereby delimiting a neck 36 and a head 37, with a round pre-cut 38 completing the circumference of the head 37 so as to form a detachable patch which is round, and each tongue includes an intermediate fold line 39.

Figure 8A:
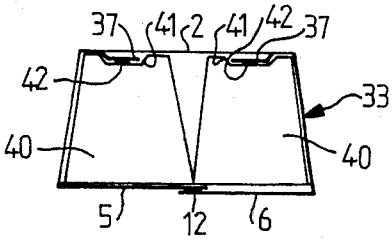
FIGS. 8*a* and 8*b* are an end view and a perspective view of a set of four frusto-conical pots having recessed tops, and packaged using the multi-item packaging of FIG. 7.
Figure 8B:
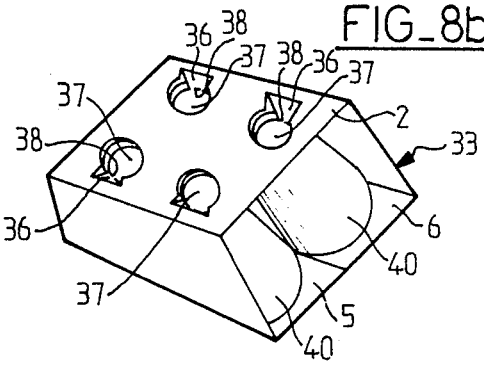

This variant is intended for objects which are typically in the form of a downwardly flared frusto-conical or pyramid-shaped pot, with the tops of the pots having recessed central portions. This is shown in FIGS. 8*a* and 8*b* which depict such objects 40 having recessed tops 41. Each patch 37 is thus easily applied against the adjacent top 41 and is fixed thereto with a spot of glue 42. As before the end flaps are glued together at 12. For the same reasons as in the preceding variant, the tongues are preferably disposed so as to extend inwardly when the card panel is folded, as shown in the drawings.

Here again, whenever an object 40 is removed the patch 37 fixed thereto is automatically separated from the packaging, with the same advantages as before, plus the additional advantage in this case of labelling being performed by the patch fixed to the top of the object.

These various examples are intended to show how the invention can be applied to packaging objects or groups of objects having a wide variety of shapes, while simultaneously serving to hold the packaged objects and to label objects after they have been separated from the packaging by means of precuts which define separable patches for each object.

The variants described all relate to two rows of two objects each, however the invention is naturally applicable to one or two rows of objects with any number of objects per row. If there is only one row, the detachable portions may be provided, in particular, for each object in one and/or the other of the adjacent side faces.

Clearly, multi-item packaging in accordance with the invention requires no additional packaging material and avoids the need for notches which are sometimes difficult to provide for objects that do not have projecting portions, and this provides a considerable advantage over the prior art, and in particular over holding techniques that make use of additional edges to form a beam.

Further, there is no risk of the card becoming delaminated and/or of visible traces of glue being left on the objects.

Finally, the packaging is completely tamper-proof since the packaging is necessarily destroyed (at least partially) in order to disengage a packaged object.

The invention is not limited to the above-described embodiments, but covers any variant using equivalent means to come within the essential characteristics of the claims.

I claim:

1. Multi-item packaging for retaining a plurality of objects, the packaging comprising a card panel having two flaps adapted to be connectable together for wrapping around said objects and for retaining them after said two flaps of said panel have been connected together, the packaging including at least one pre-cut which runs along a line disposed within an outer edge of the panel, said pre-cut defining a detachable portion capable of being fixed to at least one of said objects by gluing, said detachable portion being removable from the panel when the packaging is opened and remaining fixed to said at least one of said objects.

2. Multi-item packaging according to claim 1, wherein a central portion of the panel directly overlies the top face of said plurality of objects, and wherein the pre-cut associated with said at least one of said objects runs around a closed contour defining a separable patch.

3. Multi-item packaging according to claim 2, wherein the contour substantially conforms to the shape of the top face of the object, whereby the detached patch covers a substantial portion of said face.

4. Multi-item packaging according to claim 1, wherein a side portion of the folded panel is spaced apart from the adjacent face of a plurality of objects wrapped in the panel, and wherein the pre-cut associated with each object runs along a line which transversely interconnects two points of a continuous cutout which runs along a line disposed within the outer edge of the panel, said continuous cut-out defining a tongue, the pre-cut running along a direction which is substantially parallel to the connecting hinge of said tongue.

5. Multi-item packaging accordig to claim 4, wherein the hinge of each tongue extends essentially parallel to the general fold direction of the card panel.

6. Multi-item packaging according to claim 5, wherein the hinge of each tongue essentially coincides with a fold line of the card panel.

7. Multi-item packaging according to claim 4, wherein each tongue includes a narrow neck which is extended by a broader head beyond the pre-cut, with said head defining a separable patch.

8. Multi-item packaging according to claim 7, wherein the neck of each tongue has an intermediate fold line disposed between the hinge and the pre-cut of said tongue.

9. Multi-item packaging according to claim 7, wherein the head of each tongue is generally square or rectangular with the associated pre-cut being rectilinear and running along one of its sides, and extending the portion of the continuous cutout relating to said side.

10. Multi-item packaging according to claim 7, wherein the head of each tongue is generally circular or oval in shape with the associated pre-cut being correspondingly curved in order to run into the associated continuous cutout.

11. Multi-item packaging according to claim 7, wherein the objects wrapped in the card are organized in at least one row and are generally frusto-conical or pyramid-shaped with an upward flare, and wherein the tongue associated with each object is adjacent to a side wall of the object and extends downwardly when the card panel is folded, the tongue having a hinge which is essentially parallel to the fold direction of said panel.

12. Multi-item packaging according to claim 7, wherein the objects wrapped in the card are organized in at least one row and are generally frusto-conical or pyramid-shaped with a downward flare, and have tops which are recessed in the middle, and wherein the tongue associated with each object is adjacent to the top of the object and extends inwardly when the card panel is folded, the tongue having a hinge which is essentially parallel to the fold direction of said panel.

13. Multi-item packaging according to claim 7, wherein the objects wrapped in the card are organized in at least one row and have bottoms which are recessed in the middle, and wherein the tongue associated with each object is adjacent to the bottom of the object and extends inwardly when the card panel is folded, the tongue having a hinge which is essentially parallel to the fold direction of said panel.

* * * * *